US007100216B2

(12) United States Patent
Matechen et al.

(10) Patent No.: US 7,100,216 B2
(45) Date of Patent: Sep. 5, 2006

(54) GARMENT WITH ENERGY DISSIPATING CONFORMABLE PADDING

(75) Inventors: John M. Matechen, Irwin, PA (US); Jeffrey S. Hartung, Pittsburgh, PA (US)

(73) Assignee: Impact Innovative Products, LLC, Irwin, PA (US)

( * ) Notice: Subject to any disclaimer, the term of this patent is extended or adjusted under 35 U.S.C. 154(b) by 293 days.

(21) Appl. No.: 10/686,006

(22) Filed: Oct. 15, 2003

(65) Prior Publication Data

US 2005/0081277 A1 Apr. 21, 2005

(51) Int. Cl.
*A41D 13/00* (2006.01)

(52) U.S. Cl. ..... 2/455

(58) Field of Classification Search ..... 2/455, 2/456, 69, 79, 227, 69.5, 2.11, 108, 94, 228, 2/238, 267, 51, 247
See application file for complete search history.

(56) References Cited

U.S. PATENT DOCUMENTS

| | | | | |
|---|---|---|---|---|
| 706,250 | A | 8/1902 | Muller | |
| 2,663,020 | A | 12/1953 | Cushman | |
| 4,397,636 | A * | 8/1983 | Ganshaw | 441/65 |
| 5,062,433 | A | 11/1991 | Kummer | |
| 5,551,082 | A | 9/1996 | Stewart | |
| 6,041,786 | A | 3/2000 | DeLaTorre | |
| 6,289,524 | B1 * | 9/2001 | Wright et al. | 2/455 |
| 6,687,917 | B1 * | 2/2004 | Forsyth et al. | 2/228 |
| 2003/0167560 | A1 | 9/2003 | LaShoto | |

FOREIGN PATENT DOCUMENTS

| | | |
|---|---|---|
| EP | 1 332 685 | 1/2003 |
| FR | 2 745 986 | 3/1996 |
| FR | 2 787 298 | 11/1998 |
| WO | WO 03/022085 | 3/2003 |

OTHER PUBLICATIONS

Internet article printed Sep. 12, 2003 titled Tpro by Davies Odell-Manufacturers of TPro and Forcefield Body Armour.

* cited by examiner

*Primary Examiner*—Tejash Patel
(74) *Attorney, Agent, or Firm*—The Webb Law Firm

(57) ABSTRACT

A garment has a piece of clothing with at least one pad of conformable, energy dissipating media. The pad is positioned at a location on the clothing of the wearer to dissipate the energy resulting from a sudden impact at that location. The pad may be retained against the garment by a connector attached to the surface of the clothing or may be secured within a pocket on the garment. Additionally, the pad may be used in conjunction with hard shell padding.

36 Claims, 3 Drawing Sheets

GARMENT WITH ENERGY DISSIPATING CONFORMABLE PADDING

BACKGROUND OF THE INVENTION

1. Field of the Invention

The invention relates to padded garments and particularly relates to a garment having padding made up of energy dissipating conformable padding attached thereto.

2. Description of Related Art

In many activities padding worn by a user acts to absorb energy from a sudden impact. Such a sudden impact occurs in activities ranging from sporting activities where frequent contact is likely to vocational activities where contact is less likely, but nevertheless a very real possibility. As examples, sporting activities, to name a few, may include football, soccer, hockey, baseball, rugby and basketball while one such vocational activity may be, for example, that of a tradesman. An additional sporting activity includes race car driving, whereby the driver experiences impact transmitted from the car frame.

However, even when such padding is employed, depending upon the manner and degree to which the padding conforms to the user's body and the energy dissipating characteristics of the conformal padding material, the force from a sudden impact, which may be vibrational, may not be distributed over the area of the padding. For example, if the padding is made of a hard shell and contacts only a protriding bone, all of the force of impact may be transmitted to that bone. Even when the padding is not associated with a hard shell, if it nevertheless does not conform to the user's body and exhibit desired energy dissipation characteristics, then once again it is possible the energy from a sudden impact may not be distributed over the area of the padding but concentrated in a smaller area.

For providing a clearer explanation of the effect in response to sudden impact when hard shell padding is used, football shoulder pads will hereinafter be discussed with the understanding that the scope of this application should in no way be limited to such shoulder pads, or hard shell padding in general, but may be extended to padding used for body protection in a wide range of activities.

Directing attention to football shoulder pads, a set of shoulder pads may protect a football player from the force of a sudden impact upon the shoulder pads by distributing that force across a wider area on the body of the football player. Although many shoulder pads have a high level of adjustability, nevertheless due to the variation in shape inherent in the bodies of individuals, the contact areas and the degree of contact between the shoulder pads and the football player's body are irregular, thereby resulting in an uneven distribution of forces through the shoulder pad to the body of the player. In a worse case scenario, the shoulder pads are supported primarily by the clavicle bone and any downward force upon the shoulder pads is transmitted to the player entirely by a concentrated force upon the clavicle bone. Some shoulder pads include a protective ring around the clavicle such that forces are transmitted through this protective ring. However, even under these circumstances, there is an imperfect mating between the shoulder pads and the body of the football player such that transmission of forces produced by sudden impact upon the shoulder pads is transmitted to the player in an irregular pattern depending, first of all, on the existence of contact between the shoulder pads and the player and, second of all, on the degree to which such contact provides support. It is possible that with this irregular contact certain contact areas will absorb a greater amount of the force from sudden impact than others.

Athletic trainers frequently customize the fit and impact protection of shoulder pads by securing resilient padding to the interior of the shoulder pads in an attempt to provide a more uniform contact between the shoulder pads and the player. However, securing such padding to the inside surface of the shoulder pads may be difficult.

Furthermore, such padding ideally will follow the contour of the player's body. However, even with such padding, the force exerted upon the shoulder of the player may be uneven.

A conformal, energy dissipating padding design is needed to provide relatively uniform contact between hard shell padding and its wearer such that forces produced by sudden impact may be more effectively dissipated.

Again, while this scenario has been directed to football shoulder pads, this same problem exists with protective equipment used in many other sports including soccer, hockey, baseball, rugby and basketball.

In a separate scenario, the uniforms in many sporting activities are not intended to accommodate any padding and, furthermore, over time, a distaste on behalf of the fans and the players has developed toward the use of padding with such uniforms. However, in contact sports, such as, for example, rugby and soccer, it is believed that padding may be embraced by the players but only to the extent that such padding does not substantially change the appearance of the uniform and to the extent that such padding does not inhibit their movement.

Therefore, a need exists for padding that is conformal to the body surface it contacts and dissipates the energy of a sudden impact to participants in sports activities.

SUMMARY OF THE INVENTION

A garment has a piece of clothing with at least one pad of energy dissipating conformal media. The pad is positioned at a location on the clothing to diminish the effect of a sudden impact upon a wearer of the garment. Depending upon the application, this garment may be utilized in conjunction with hard shell padding or may be used alone without hard shell padding. In one embodiment a connector is attached to the surface of the clothing for securing the at least one pad of media to the clothing.

A system for more uniformly distributing the forces of sudden impact upon hard shell padding has a garment comprised of clothing worn by a wearer and hard shell padding placed over the garment to protect a portion or portions of the body of the wearer, wherein the hard shell padding does not conform entirely to the wearer's body such that the force imparted to the wearer's body through sudden impact is concentrated at the points of contact between the padding and the body of the wearer. To compensate for this, the system also includes at least one pad of energy dissipating conformal media secured at a location on the clothing between the wearer's body and the hard shell padding. The pad conforms between the hard shell padding and the wearer's body such that the force of a sudden impact upon the hard shell padding causes the pad to uniformly distribute the force of impact over the area of the pad in contact with the hard shell padding and the wearer's body.

The padding material is a light weight, viscoelastic polymer that exhibits fluid-like characteristics in the absence of a sudden impact, and acts as a solid when subjected to a sudden impact. Polyborosiloxane is a preferred polymer material.

DETAILED DESCRIPTION OF THE INVENTION

Figure 1:
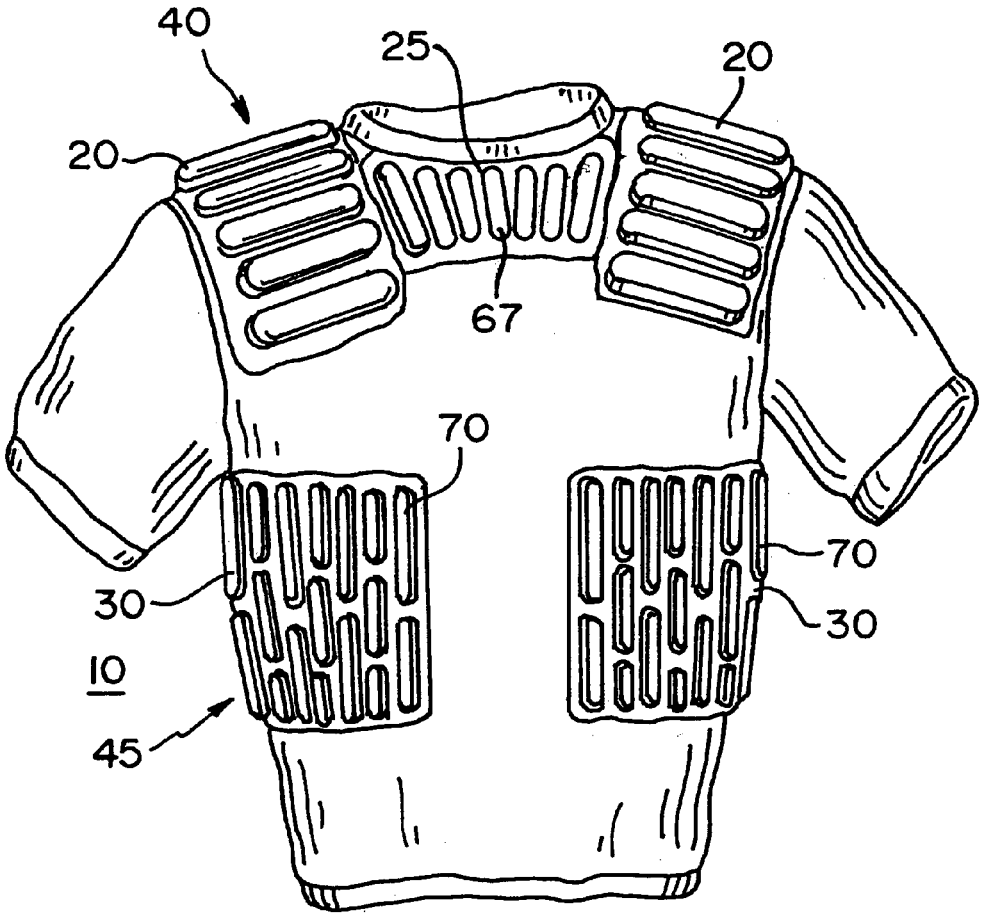
FIG. 1 is a perspective view of a garment in the form of a shirt in accordance with the subject invention.

FIG. 1 illustrates a garment 10 comprised of a piece of clothing 15 which, in this example, is a shirt. While sleeves are shown, the garment 10 may be sleeveless. Additionally, while FIG. 1 appears to be a garment used for football, the applications of the subject invention apply to garments used in many different sports or other activities. Returning to FIG. 1, at least one pad 20 of energy dissipating conformal media is positioned at a location upon the clothing 15 to protect a wearer from the force of sudden impact. The garment 10 illustrated in FIG. 1 is intended to be utilized by a football player such that the garment 10 is located against the wearer's body and a pair of shoulder pads, which may or may not include a flak jacket extension, are placed over the garment 10. The garment 10 may be a tight fitting shirt, often times known as a compression shirt, which custom fits the wearer such that the shirt does not easily shift upon the body of the wearer. As illustrated in FIG. 1, pads 20 may be located on the clothing 15 in the shoulder region 40 and additionally in the rib region 45. Returning to FIG. 1, in a preferred embodiment the pads 20 and 25 are located upon the clothing to protect the scapula, clavicle and upper ribs of the user. In other embodiments of this invention, the pads 20 could be located at the rib cage, kidneys or spleen. Additionally, the pads 20 could be located to cover the tailbone. Furthermore, the garment 10 could also be turned inside-out such that the pads 20 would be on the inside of the clothing 15, as opposed to the outside of the clothing 15 illustrated in FIG. 1.

A padded garment in accordance with the invention may likewise be produced for use by race car drivers to provide both conformal contact between the driver and the seat and energy dissipating response to sudden impact.

Figure 2:
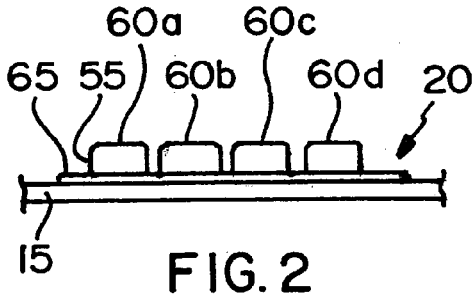
FIG. 2 is an end view of a pad in accordance with the subject invention.
Figure 3:
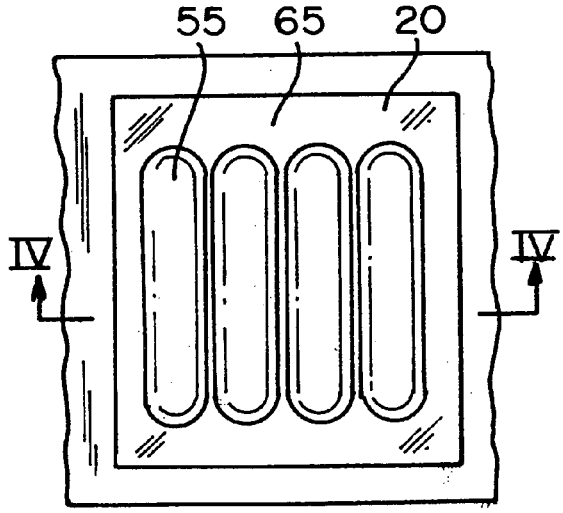
FIG. 3 is a top view of the pad illustrated in FIG. 2.
Figure 4:
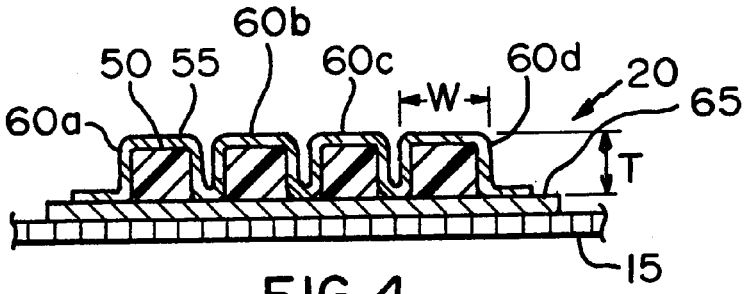
FIG. 4 is a cross-sectional view along arrows 4—4 in FIG. 3.

As will now be discussed, a pad 20 may have different configurations and may be secured to the clothing 15 in a variety of different ways. Directing attention to FIGS. 2–4, the pad 20 is comprised of a conformable media 50 confined within an encasement 55. In a preferred embodiment, the media is a polymer composition such as polyborosiloxane. The pad 20 may be made up of a plurality of adjacent projections 60*a*–*d* placed parallel to and adjacent with one another. A plurality of adjacent projections 60*a*–*d* may be mounted upon a common substrate 65. Each projection 60*a*–*d* may be comprised of a strip made up of media 50 surrounded by an encasement 55.

Briefly returning to FIG. 1, the projections 60*a*–*d* may be positioned upon the clothing 15 and oriented such that the associated projections conform with the motion of a user's body. In particular, pads 25 have projections that are positioned in such a fashion.

Furthermore, while pad 20 is comprised of a plurality of projections 60*a*–*d* which are laterally aligned with one another, in accordance with another embodiment of the subject invention, it is possible that a pad 30 has a plurality of projections 70 that may be staggered relative to one another.

Figure 5:
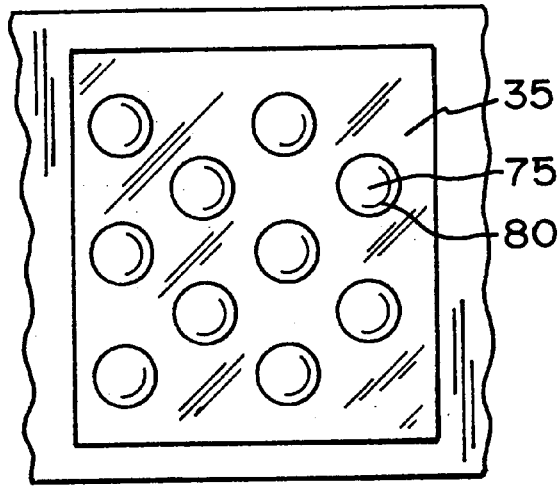
FIG. 5 is a top view of a pad wherein the projections are discs.

In another embodiment, illustrated in FIG. 5, a pad 35 may be comprised of projections 75 that are disc shaped and, once again, made up of media (not shown) surrounded by an encasement 80.

While FIG. 1 illustrates the pads 20 on the exterior of the garment 10, it is possible for the garment 10 to exist with the inside out such that the pads 20 are between the user's body and the clothing 15. This variation may be applied to any embodiment discussed herein.

Returning to FIG. 4, the thickness T of a typical projection may be approximately ⅜ of an inch. The width W of such a projection may be approximately ¾ of an inch.

Figure 6:
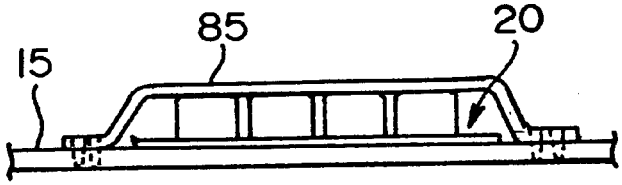
FIG. 6 is an end view of a portion of a garment, wherein the pad is contained within an enclosure.

The pad 20, or any other pad discussed herein, may be secured to the clothing 15 in a variety of different ways. As illustrated in FIG. 6, the pad 20 may be located within an enclosure 85 on the clothing 15. The enclosure 85 resembles a pocket upon the clothing 15 and is typically secured to the clothing by sewing. It should be appreciated that the enclosure 85 may be secured to the clothing 15 using any of a number of variety of techniques known by those skilled in the art of manufacturing clothing. In one particular embodiment, the enclosure 85 may be a pocket having a reclosable end (not shown). Such a reclosable end may be a flap that covers the open end of the enclosure 85 and may be easily envisioned by those skilled in the art of manufacturing clothing.

Figure 7:
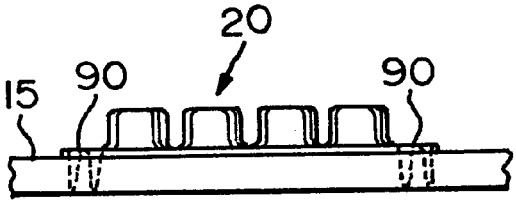
FIG. 7 is a cross-sectional view of a pad sewn to clothing.

The pad 20 may also be secured to the clothing 15 using a connector attached to the surface of the clothing. In particular, and directing attention to FIG. 7, the pad 20 may be secured directly to the clothing 15 utilizing stitching 90 attaching the pad 20 to the clothing 15.

Figure 8:
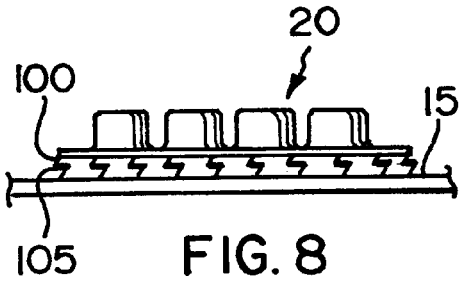
FIG. 8 is a cross-sectional view of a pad secured to clothing with Velcro connectors.

Directing attention to FIG. 8, the connector may be a pair of interlocking strips 100, 105 each having hooks in which one strip 100 is secured to the pad 20 and the other strip 105 is secured to the clothing 15 such that when the strips 100, 105 are mated, the pad 20 is secured to the clothing 15.

Figure 9:
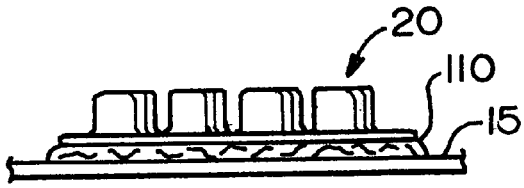
FIG. 9 is a cross-sectional view of a pad secured to clothing with adhesive.

In another embodiment, illustrated in FIG. 9, the connector may be a layer of adhesive 110 between the pad 20 and the clothing 15.

Figure 10:
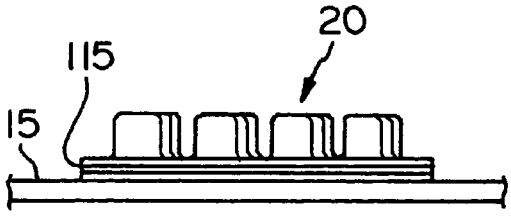
FIG. 10 is a cross-sectional view of a pad secured to clothing with double sided tape.

Directing attention to FIG. 10, the connector may also be double sided tape 115 between the pad 20 and the clothing 15.

Figure 11:
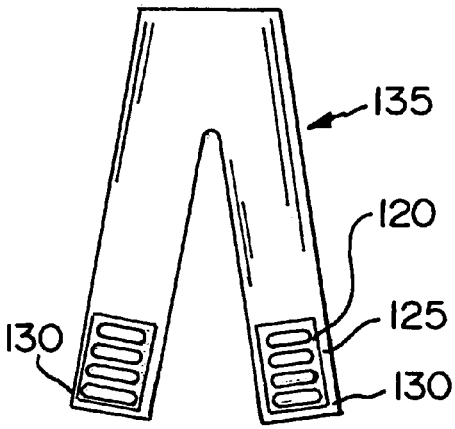
FIG. 11 is a sketch of pads in accordance with the subject invention secured to a pair of pants.

While what has been described so far, is the application of the pad to a shirt, as illustrated in FIG. 11, it is also possible to apply the pad 120 within the shin region 125 on each pants leg 130 of a pair of pants 135.

Figure 12:
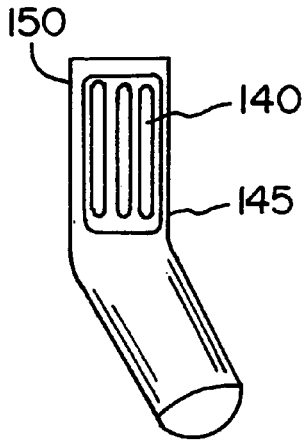
FIG. 12 is a sketch of a pad in accordance with the subject invention secured to a sock.

As furthermore illustrated in FIG. 12, it is possible to apply a pad 140 on the shin region 145 of a sock 150. It is be easily envisioned that a sleeve (not shown) fitting over the shin of a wearer, similar to the sock 150 but without a foot portion, could also be used with a pad attached thereto.

Depending upon the particular application, the pad discussed herein may be used in conjunction with hard shell padding or may be used alone without hard shell padding.

Additionally, a garment in accordance with the subject invention may be utilized by race car drivers and, under such circumstances, the garments may include padding in the areas of contact between the driver and the driver's seat. Typical areas of contact between the driver and the driver seat include the buttocks, tailbone, hip and torso regions. As a result, a garment for such a driver could be an elongated shirt, a pair of pants or a jumpsuit and would include a portion around the waist, hip, buttocks and tailbone regions that would provide such padding.

Figure 13:
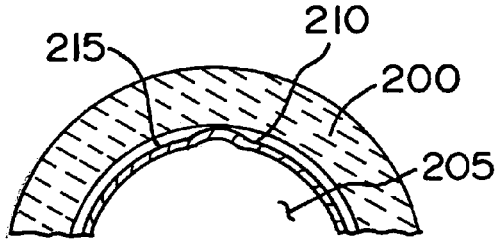
FIG. 13 PRIOR ART
FIG. 13 is prior art illustrating a cross-sectional view of a shoulder pad resting upon the shoulder area of a user.

The media and associated pads have so far been discussed in the context of dissipating energy. However, the media is a flowable conformable material and, for that reason, provides additional benefits to a user. In particular, directing attention to FIGS. 13 and 14 and once again using as an example a set of shoulder pads, the subject invention may also be directed to a system for more uniformly distributing the forces of sudden impact upon hard shell padding. FIG. 13 shows a cross-sectional view of a pair of shoulder pads 200 placed over the shoulder area 205 of a user. The shoulder area 205 may be covered by a shirt 210 which may be a tight fitting shirt which fits closely against the body of the user. Because of the unique contour of any given user's shoulder, there are gaps 215 and other areas of non-uniform pressure between the shoulder pads 200 and the shoulder area 205 of the user. As a result, impact upon the shoulder pad 200 will be imparted to the shoulder area 205 in an uneven fashion representative of the irregular contact between the shoulder pads 200 and the shoulder area 205. Additionally, it is possible that the shoulder pads 200 may shift within the shoulder area 205 when subjected to impact forces.

Figure 14:
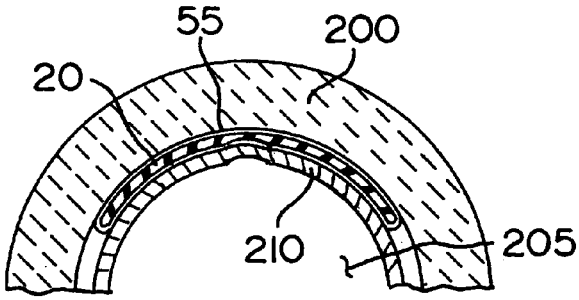
FIG. 14 is a cross-sectional view of a shoulder pad resting upon a shoulder area but incorporating the pads in accordance with the subject invention.

In accordance with the subject invention, FIG. 14 illustrates the shoulder pads 200 about the shoulder area 205 of the user. However, now a pad 20 in accordance with the subject invention is placed between the shoulder pad 200 and the shoulder area 205. The conformal nature of the media within the pad 20 provides a more uniform contact between the shoulder area 205 and the shoulder pad 200 such that, first of all, the gaps 215 (FIG. 13) are eliminated or minimized, thereby more uniformly distributing the force from the shoulder pad 200 to the shoulder area 205. Furthermore, it is possible to utilize a material for the encasement 55 that resists slipping to better maintain the position of the shoulder pad 200 upon the shoulder area 205.

The use of such pads may also be applied to other hard shell padding such as a shin guard, wherein the clothing is a sock and the pad is secured to the clothing between the shin guard and the shin of the user. Additionally, the hard shell padding may be a forearm guard and the clothing may be a shirt, wherein the pad is secured to the clothing 15 between the forearm guard and the forearm of the user. Furthermore, under certain conditions, the pad may be secured to clothing for use without a hard shell padding. For example, it is possible that under certain circumstances shin guards may have only the pad secured directly to a sock or sleeve positioned about the shin of the wearer without a hard shell padding.

A typical pad may be made of a polyurethane encasement that is vacuum molded against a polyurethane substrate around the media. The encasement may also be made of urethane, PVC, nylon or neoprene. While the media is somewhat fluid and easily conforms to different shapes to maximize the benefits of this conformability, it is necessary for the encasement to be pliable. Therefore, the encasement may be a layer of polyurethane of less than 1 mil. One type of polyurethane that may be utilized is polyether aromatic polyurethane such as Stevens Polyurethane ST-1880-87 provided by the Stevens Urethane Company.

It is also possible to produce an encasement around the pad by dipping the pad into an encasement fluid, such as a vinyl solution.

It is also possible to surround the media in an encasement made of cloth woven sufficiently tightly to prevent permeation of the media therethrough.

Figure 15:
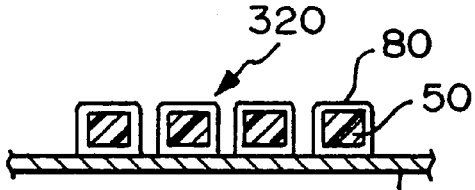
FIG. 15 is a cross-sectional view similar to the view of FIG. 4 but illustrating the pad of media welded directly to the clothing.

What has so far been discussed, is an energy dissipating garment having a piece of clothing with at least one pad with at least one pad of energy dissipating conformal media, wherein the at least one pad is secured to the clothing utilizing an intermediate connector. Since a typical pad may be made of a polyurethane encasement, it is possible to weld the pad directly to the garment. Directing attention to FIG. 15, when the material of the pad 320 is nylon and when the material of the clothing 15 is also nylon, then it is possible to secure the pad 320 directly to the clothing utilizing any number of known technologies including RF welding and UV welding. Under such circumstances, although the pad 320 cannot be removed from the clothing 15 and the opportunity to launder the garment 10 may be limited, such a mechanism to secure the pad 320 to the clothing 15 may provide cost savings that may overcome the benefit provided by the option to remove a pad 20 from enclosure 85 in the clothing 15. The encasement 80 around the media 50 and the material of the clothing 15 may also be other materials or a combination of materials suitable for RV welding or UV welding.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the fill breadth of the appended claims and any and all equivalents thereof.

The invention claimed is:

1. A garment comprising a piece of clothing having at least one pad of conformal, energy dissipating media, wherein the pad is positioned at a location on the clothing to diminish the effect of a sudden impact on a wearer of the garment;

wherein each pad is comprised of conformal media surrounded by an encasement, wherein the media is a polymer composition; and wherein the encasement is welded directly to the clothing.

2. The garment according to claim 1, wherein the encasement is made of one from the group consisting of polyurethane, urethane, PVC, nylon and neoprene.

3. The garment according to claim 1, wherein the encasement material is polyurethane and the clothing material is nylon.

4. The garment according to claim 1, wherein the encasement material is nylon and the garment material is nylon.

5. The garment according to claim 1, wherein the welding is done using RF welding or UV welding.

6. The garment according to claim 1, wherein the polymer composition is polyborosiloxane.

7. The garment according to claim 1, wherein the pad is made up of a plurality of adjacent projections.

8. The garment according to claim 7, wherein the plurality of adjacent projections are mounted upon a common substrate.

9. The garment according to claim 7, wherein the projections are strips oriented parallel to one another.

10. The garment according to claim 7, wherein each projection is a disc comprised of conformal media surrounded by an encasement.

11. The garment according to claim 1, wherein the thickness of a pad is ⅜ inch.

12. The garment according to claim 1, wherein the clothing is a shirt.

13. The garment according to claim 12 wherein a pad is located in the shoulder region of the shirt.

14. The garment according to claim 12, wherein a pad is located in the rib region of the shirt.

15. The garment according to claim 1, wherein the clothing is a pair of pants having pant legs.

16. The garment according to claim 15, wherein a pad is located on the clothing in the thigh region of one or more pant legs.

17. The garment according to claim 1, wherein the clothing is a sleeve and the pad is located on the sleeve.

18. The garment according to claim 17, wherein the sleeve is adapted to fit around the shin of a wearer as a shin guard.

19. The garment according to claim 17, wherein the sleeve is adapted to fit around the thigh of a wearer as a thigh guard.

20. The garment according to claim 17, wherein the sleeve is adapted to fit around the forearm of a wearer as a forearm guard.

21. The garment according to claim 1, wherein a pad is located on the clothing in the region of the tailbone of a wearer.

22. A system for more uniformly distributing the forces of sudden impact upon hard shell padding comprising:

a) a garment of clothing worn by a wearer;

b) hard shell padding placed over the garment to protect a portion or portions of the body of the wearer;

c) at least one pad of energy dissipating conformal media secured at a location on the garment between the wearer's body and the hard shell padding wherein the pad conforms between the hard shell padding and the wearer's body such that the force of a sudden impact upon the hard shell padding causes the pad to distribute the force of impact over the area of the pad in contact with the wearer's body; and d) wherein each pad is comprised of conformal media surrounded by an encasement and each pad is welded directly to the garment.

23. The system according to claim 22, wherein the conformal media is also energy dissipating.

24. The system according to claim 22, wherein the conformal media is polyborosiloxane.

25. The system in accordance with claim 22, wherein the wearer is a person, the hard shell padding is a set of shoulder pads, the clothing is a shirt and wherein the at least one pad is a plurality of pads which are secured to the clothing in the region of the shoulders.

26. The system in accordance with claim 25, wherein the pads are further secured to the clothing to protect the scapula, clavicle and upper ribs of the wearer.

27. The system in accordance with claim 22, wherein the wearer is a person, the hard shell padding is a shin guard, the garment is a sleeve and wherein the at least one pad is secured to the sleeve between the shin guard and the shin of the wearer.

28. The system in accordance with claim 22, wherein the wearer is a person, the hard shell padding is a forearm guard, the garment is a sleeve and wherein the at least one pad is secured to the sleeve between the forearm guard and the forearm of the wearer.

29. A method of securing a pad having a conformal, energy dissipating media surrounded by an encasement; and each pad is welded directly to the garment, comprising the steps of:

a) confining energy dissipating media within an encasement to define a pad, wherein the media is comprised of a polymer composition;

b) positioning the pad at a location on the garment to diminish the effect of a sudden impact on a wearer of the garment; and c) welding the pad directly to the garment.

30. The method according to claim 29, wherein the step of welding is comprised of RF welding.

31. The method according to claim 29, wherein the step of welding is comprised of UV welding.

32. The method according to claim 29 wherein the garment and the pad are each made of nylon.

33. The method according to claim 29, wherein the garment is made of nylon and the pad is made of polyurethane.

34. The method according to claim 29, wherein the encasement and the garment are made of materials suitable to be welded to one another.

35. A garment comprising a piece of clothing having at least one pad of conformal, energy dissipating media, wherein the pad is positioned at a location on the clothing to diminish the effect of a sudden impact on a wearer of the garment;

wherein each pad is comprised of conformal media surrounded by an encasement and wherein the media is a fluid in the absence of a sudden impact, and a solid when the pad is subjected to a sudden impact; and wherein the encasement is welded directly to the clothing.

36. A method of securing a pad to a garment, comprising the steps of:

a) confining energy dissipating media within an encasement to define the pad, wherein the media is a fluid in the absence of a sudden impact, and a solid when the pad is subjected to a sudden impact;

b) positioning the pad at a location on the garment to diminish the effect of a sudden impact on a wearer of the garment; and c) welding the pad directly to the garment.

* * * * *